US009583027B1

(12) United States Patent
Anderson et al.

(10) Patent No.: US 9,583,027 B1
(45) Date of Patent: Feb. 28, 2017

(54) CRASHWORTHY PORTABLE TRAFFIC CONTROL SIGN

(75) Inventors: Jeffrey Craig Anderson, Brooklyn, MI (US); Martin F. Powelson, Brooklyn, MI (US)

(73) Assignee: MFP INDUSTRIES, LLC, Canton, MI (US)

( * ) Notice: Subject to any disclaimer, the term of this patent is extended or adjusted under 35 U.S.C. 154(b) by 0 days.

(21) Appl. No.: 11/125,386

(22) Filed: May 9, 2005

(51) Int. Cl.
*G09F 7/18* (2006.01)
*G09F 7/00* (2006.01)

(52) U.S. Cl.
CPC ..... *G09F 7/00* (2013.01)

(58) Field of Classification Search
CPC .... G09F 7/00; G09F 7/18; G09F 13/16; E01F 9/012
USPC ..... 40/612, 607.01–607.12, 495, 474; D20/21; 248/548, 900
See application file for complete search history.

(56) References Cited

U.S. PATENT DOCUMENTS 489,027 A * 1/1893 McDonald ..... 40/474
1,582,931 A 5/1926 Kennedy
1,821,580 A * 9/1931 Rogers ..... 248/188.1
2,775,221 A * 12/1956 Olson ..... E04H 12/32 116/173
3,933,117 A 1/1976 Maietta
4,032,248 A 6/1977 Parduhn et al.
4,061,435 A 12/1977 Schmanski et al.
4,092,081 A 5/1978 Schmanski
4,249,832 A 2/1981 Schmanski
4,288,053 A 9/1981 Sarkisian
4,312,600 A * 1/1982 Schaaf et al. ..... 404/6
4,318,238 A * 3/1982 Macarle, Jr. ..... 40/492
4,498,657 A 2/1985 Werner
4,511,281 A 4/1985 Schmanski
4,522,530 A 6/1985 Arthur
4,571,118 A 2/1986 Schmanski
4,572,473 A 2/1986 Seely
4,674,432 A 6/1987 Schmanski
4,676,015 A 6/1987 Stoudt
4,799,448 A * 1/1989 Junker ..... 116/63 P
4,863,138 A 9/1989 Dicke et al.
4,893,455 A 1/1990 Hughes
5,181,695 A 1/1993 Arthur
(Continued)

FOREIGN PATENT DOCUMENTS

FR 2343198 A * 11/1977

OTHER PUBLICATIONS

Ross, et al., "NCHRP Report 350: Recommended Procedures for the Safety Performance Evaluation of Highway Features," National Academy Press 1993.

*Primary Examiner* — Cassandra Davis
(74) *Attorney, Agent, or Firm* — Dickinson Wright PLLC

(57) ABSTRACT

The specification discloses a portable traffic control sign comprising a stand capable of resting on a support surface, at least one mast portion extending upwardly from the stand, the at least one mast portion having a bottom and a top, a substantially hollow interior and an outside diameter of less than approximately 1.75 inches, at least one sign panel connected to the at least one mast portion, and a reinforcing member fixedly disposed in the hollow interior of each at least one mast portion, the reinforcing member having a length sufficient to reinforce the at least one mast portion proximate the area of probable impact by a motor vehicle.

23 Claims, 6 Drawing Sheets

(56) References Cited

U.S. PATENT DOCUMENTS

| | | | | |
|---|---|---|---|---|
| 5,438,782 | A | 8/1995 | Belobraydich et al. | |
| 5,502,909 | A | 4/1996 | Rabkin | |
| 5,611,509 | A | 3/1997 | Kulp et al. | |
| 5,624,092 | A | 4/1997 | Kulp et al. | |
| 5,738,317 | A | 4/1998 | Hugron | |
| 5,836,558 | A | 11/1998 | Kulp et al. | |
| 6,264,162 | B1 * | 7/2001 | Barnes et al. | 248/548 |
| 6,430,855 | B1 | 8/2002 | Gertz et al. | |
| 7,171,774 | B1 * | 2/2007 | Lang | 40/606.04 |

* cited by examiner

CRASHWORTHY PORTABLE TRAFFIC CONTROL SIGN

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

FIELD OF THE INVENTION

The present invention pertains generally to traffic control devices, and more particularly to a portable (i.e., not fixed) traffic control sign comprising a stand capable of resting on a support surface, at least one mast portion extending upwardly from the stand, the at least one mast portion having a bottom and a top, a substantially hollow interior and an outside diameter of less than approximately 1.75 inches, at least one sign panel connected to the at least one mast portion, and a reinforcing member fixedly disposed in the hollow interior of each at least one mast portion, the reinforcing member having a length sufficient to reinforce the at least one mast portion proximate the area of probable impact by a motor vehicle.

BACKGROUND OF THE INVENTION

Temporary traffic control devices such as, for example, warning and speed-limit signs are widely employed throughout the United States and elsewhere to control the movement of vehicular traffic in work-zones proximate the site of roadway or roadside construction. Because of their use in proximity to roadways, such traffic control devices are often hit by motor vehicles and so must be designed to suffer vehicular impacts without injuring any occupants of the striking motor vehicle.

Conventionally, traffic control signs comprise, as shown in FIG. 1, a stand or base including a pair of horizontally disposed legs 10 for resting on a support surface such as the ground, pavement, etc., each horizontal leg 10 further including a vertically oriented socket 11 for removably receiving therein one of a pair of upstanding supports or masts 12 to which is affixed a sign panel 13. The sign panel 13 is generally of a substantially rigid material, such as aluminum, wood, composite, etc. Sandbags S or other ballast are usually provided over top of the legs 10 to keep the traffic control sign in place in an upright orientation. The legs 10 and sockets 11 of the base, as well as the masts 12, are typically constructed of metal tubing. For the legs 10 and sockets 11, such tubing is usually of 2 inch outside dimensions; for the masts 12, the tubing is typically characterized by outside dimensions of no larger than approximately 1.75 inches. The mast 12 tubing may further include a plurality of holes 14 therein for selectively mounting the sign panel 13 in a desired position.

Generally speaking, a lower portion of the masts 12 constitutes the point of impact for a motor vehicle, and upon such impact one or both masts 12 may be sufficiently bent to become "hooked" about the striking motor vehicle's bumper. In such situations, the striking motor vehicle carries the traffic control sign forward following impact, and the forward momentum of the motor vehicle results in the accelerated rotational motion of the traffic control sign about the point of contact between the mast 12 and the motor vehicle's bumper, thereby causing the top of the mast 12, and possibly the sign panel 13, to strike the motor vehicle with considerable force.

In consequence of the foregoing, the National Cooperative Highway Research Program ("NCHRP") has established crashworthiness standards for all work-zone traffic control devices, which standards have further been adopted by the Federal Highway Administration ("FWHA") in respect of the National Highway System ("NHS"). These standards are embodied in NCHRP Report 350: "Recommended Procedures for the Safety Performance Evaluation of Highway Features" (National Academy Press, 1993), the disclosure of which is incorporated herein by reference in its entirety. In respect of traffic control signs in particular, the relevant evaluation standard is described in Test Designation 3-71. According to this standard, none of the constituent parts of the traffic control device must enter the motor vehicle's passenger compartment, or otherwise deform that compartment to an extent that might cause serious injury to the motor vehicle's occupant.

In light of these crashworthiness standards, the transportation-regulating bodies of some states have redefined their own standards for traffic control devices which can be deployed on the roads within their jurisdiction, including roads of the NHS, to comply with the standards set out by the NCHRP. In the State of Michigan, for instance, there has recently been developed by the Michigan Department of Transportation ("MDOT") a new standard for portable traffic control signs which has been determined to comply with the aforementioned standards. By this new standard, the conventional traffic control sign as discussed previously in conjunction with FIG. 1 has been modified to include, inter cilia, masts of 1.75 inch outside diameter having disposed over a part of the length thereof stiffening tubing of 1.96 inch outside diameter. Unfortunately, this traffic control sign is occasioned by several drawbacks. Firstly, the sign is, by its modified construction, both heavier and more bulky, in consequence of which it is also less easily man-portable. Secondly, the thus modified traffic control sign incorporates components—namely, the masts and stiffening tubes—not found in much of the considerable existing inventory of traffic control devices owned by the many private businesses responsible for deploying traffic control devices in work-zones throughout the country. On the contrary, and as previously discussed, such existing inventory of traffic control signs are characterized by masts having outside diameters of less than 1.75 inches, and most typically on the order of approximately 1.5 inches. In view of this fact in particular, it will be necessary for the concerned private businesses to replace or significantly modify their existing inventories of traffic control signs in order to comply with the safety guidelines established by the NHWA, MDOT, and numerous other states.

In light of the above, it would be desirable to provide a means for modifying the considerable existing inventory of traffic control signs to bring the same into compliance with crashworthiness standards with the least possible expense, which means do not render the modified signs considerably less man-portable.

SUMMARY OF THE DISCLOSURE

The present invention addresses and solves the problems discussed above, and encompasses other features and advantages, by providing a stand capable of resting on a support surface, at least one mast portion extending upwardly from the stand, the at least one mast portion having a bottom and a top, a substantially hollow interior and an outside diameter of less than approximately 1.75 inches, at least one sign panel connected to the at least one mast portion, and a reinforcing member fixedly disposed in the hollow interior of each at least one mast portion, the reinforcing member having a length sufficient to reinforce the at least one mast portion proximate the area of probable impact by a motor vehicle.

According to one feature hereof, the traffic control sign of the present invention is further characterized in that, in an impact at an angle of from 0 to 20 degrees relative to an imaginary line running perpendicular to the plane of either of the front or rear surfaces of the at least one sign panel, the impact occurring between the traffic control sign and a motor vehicle of approximately 1800 lbs traveling at approximately 62 mph, the traffic control sign does not penetrate into the occupant compartment of the motor vehicle.

Per another feature of this invention, the reinforcing member comprises steel and, more specifically, steel tube having an inside diameter of 1 inch. In one embodiment, the reinforcing member is fixedly disposed proximate the bottom of the at least one mast and has a length of approximately 48 inches.

Further to still another feature of the instant invention, the at least one sign panel is positioned at a distance from the at least one mast portion. Such relative positioning may, per one feature hereof, be accomplished by means of a spacer positioned between the at least one sign panel and the at least one mast portion. According to one feature, each such spacer is at least partially disposed in a bore provided in the sign panel. Per another feature, each such spacer has a thickness of approximately 0.625 inches.

These and other features and advantages of the present invention will be better understood upon reference to the written description and drawings, of which:

WRITTEN DESCRIPTION

Figure 1:
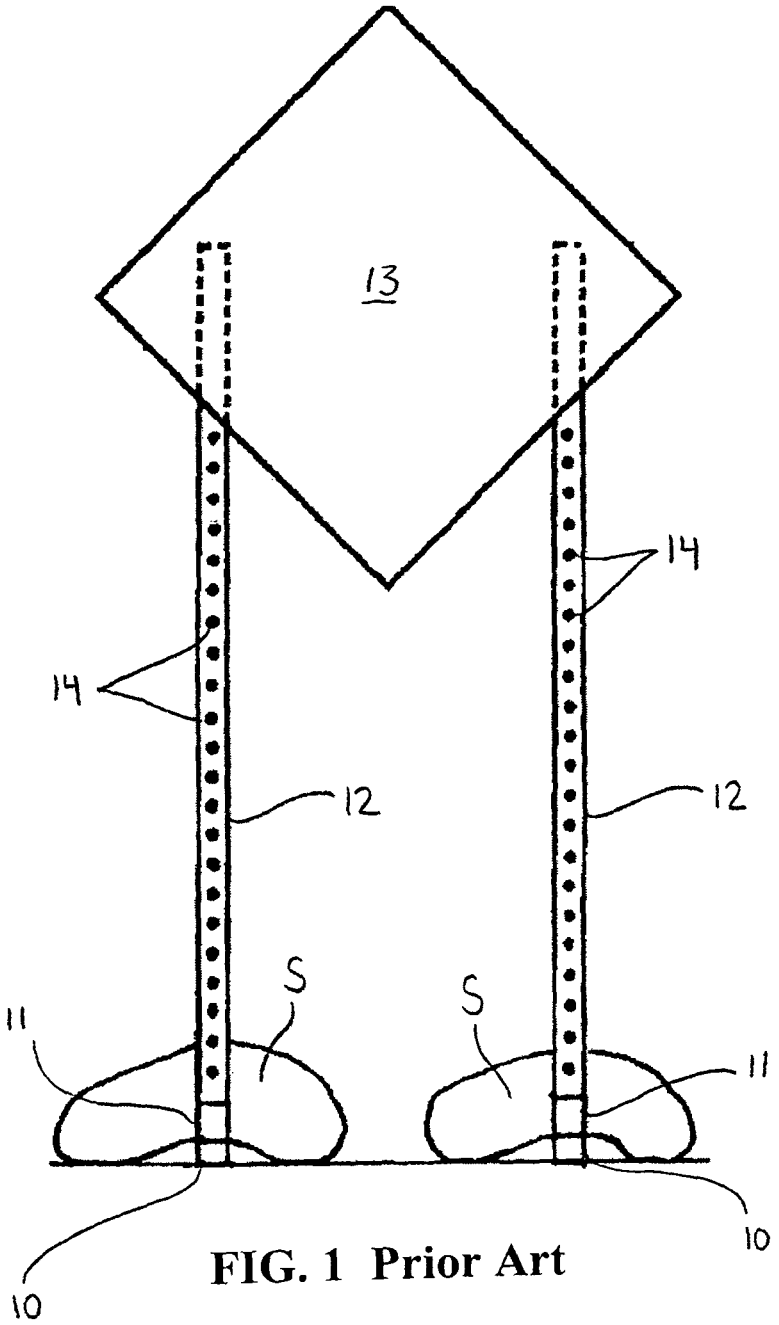
FIG. 1 Prior Art
FIG. 1 is an elevational view of an exemplary traffic control sign of conventional construction.

Referring now to the drawings, wherein like numerals indicate like or corresponding parts among the several views, the present invention will be seen to most generally comprise a portable traffic control sign 20 comprising a stand 25 capable of resting on a support surface, at least one mast portion 35 extending upwardly from the stand 25, the at least one mast portion 35 having a substantially hollow interior and an outside diameter of less than approximately 1.75 inches, at least one sign panel portion 40 disposed on the at least one vertical mast portion 35, and a reinforcing member 50 (shown in phantom lines) disposed in the hollow interior of each at least one mast portion 35, the reinforcing member having a length sufficient to reinforce the at least one mast portion 35 proximate the area of probable impact by a motor vehicle. (FIGS. 2 and 2*a*.)

By such construction, and as explained further hereinbelow, the traffic control device of the instant invention is characterized by its compliance with a standard testing regime for establishing compliance with FHWA safety standards, Test Designation 3-71 of NCHRP Report 350: "Recommended Procedures for the Safety Performance Evaluation of Highway Features" (National Academy Press, 1993), the disclosure of which is incorporated herein by reference in its entirety.

Figure 2:
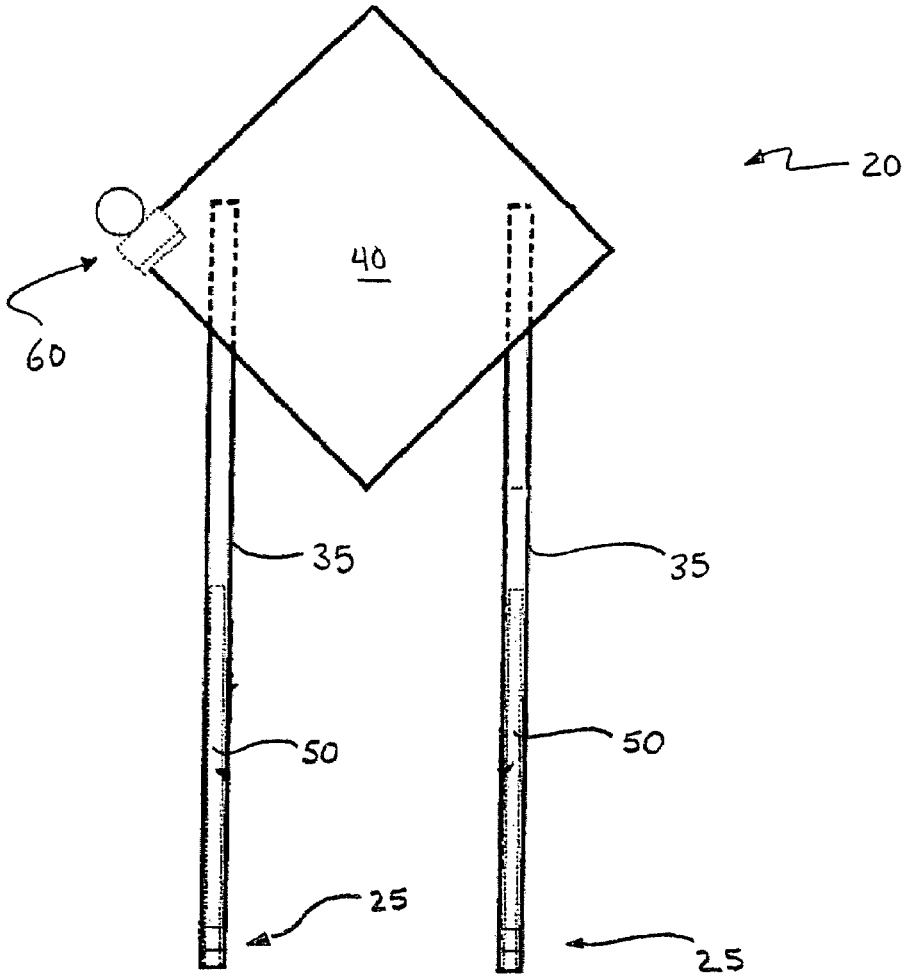
FIG. 2 is a front elevational view of a traffic control sign according to the instant invention.
Figure 2A:
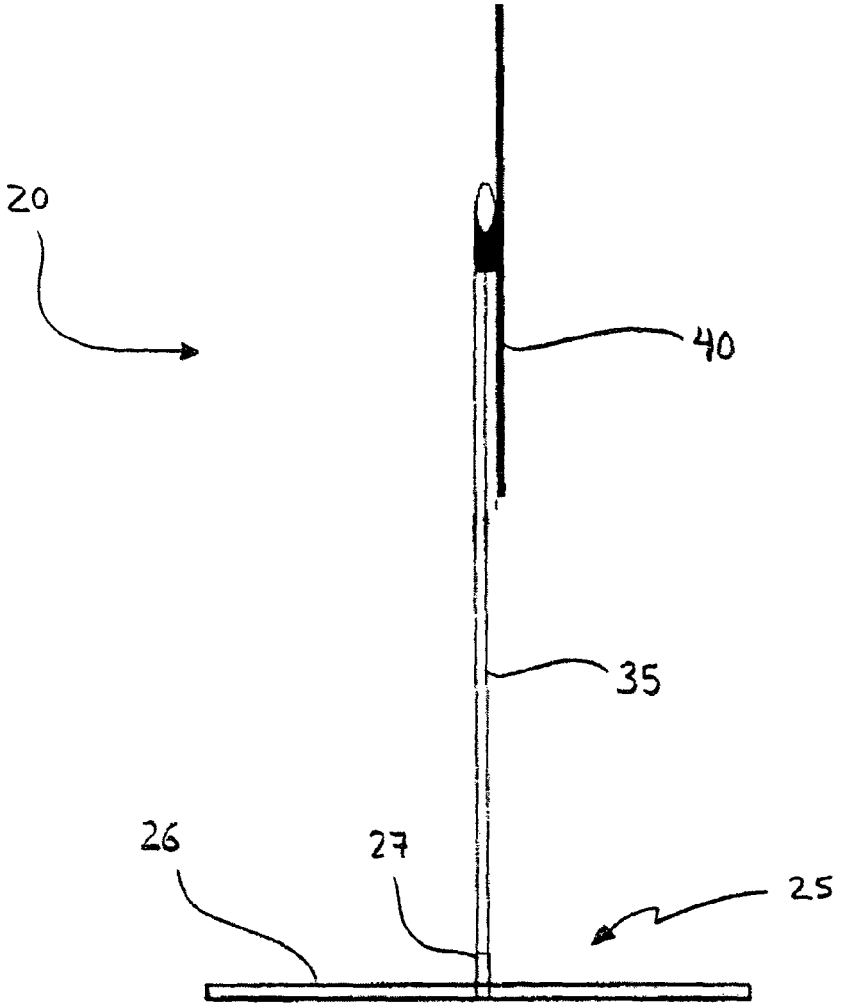
FIG. 2*a* is a lateral elevational view of the portable traffic control sign of FIG. 2

Still referring to FIGS. 2 and 2*a*, the stand 25 will be seen to comprise, in the exemplary embodiment hereof, a pair of horizontally oriented legs 26 each including a vertically oriented socket portion 27 dimensioned to removably slidingly receive therein one of the mast portions 35. According to the illustrated embodiment, each of the legs 26 comprises steel tubing of approximately 0.25 inch wall thickness and a 2 inch outer diameter, with each leg 26 having longitudinal dimensions of approximately 72 inches. Each of socket portions 27 similarly comprises, in the illustrated embodiment, steel tubing of approximately 0.25 inch wall thickness and 2 inch outside diameter, and having longitudinal dimensions of approximately 8 inches. Socket portions 27 are each secured to the respective leg 26, for instance by welding. Of course, the foregoing construction is exemplary only, and those of ordinary skill in the art will appreciate that other configurations of the stand 25, to include other materials and/or material thicknesses of at least comparable strength, may be adopted to the traffic control sign of the present invention without departing from the broader aspects thereof as set forth in the appended claims.

With continuing reference to FIG. 2, wherein the exemplary traffic control sign 20 is shown to comprise a pair of mast portions 35, each such mast portion 35 is constructed of metal, such as, for example, 12-14 gage wall-thickness steel square tubing. A plurality of holes (not shown) may, as with conventional traffic control signs, be defined in each mast 35 to facilitate mounting one or more sign panels, such as sign panel 40, thereon. In the embodiment as shown, mast portions 35 are each further characterized by an outside diameter of approximately 1.50 inches. However, it is contemplated that this invention may be employed in traffic control signs having one or mast portions with outside diameters of up to approximately 1.75 inches.

While two masts 35 are shown, it is contemplated that the instant invention may be adapted to traffic control signs comprising more or fewer masts. And as with the stand 25, those skilled in the art will understand that the construction herein specified is exemplary only, and that the one or more masts 35 may be formed from other materials and/or material thicknesses of at least comparable strength.

Sign panel 40 may take any shape and be characterized by such dimensions as required, according to convention, and may likewise be fashioned from any suitable material, including, by way of non-limiting example, metal, wood, composite, etc. In the illustrated embodiment, sign panel 40 comprises a diamond-shaped sign having dimensions of approximately 48 inches on a side, the sign panel being fabricated from approximately 0.625" thick reflective plywood.

Still referring to FIG. 2, each reinforcing member 50 is characterized by a length sufficient to reinforce the associated mast portion 35 proximate the area of probable impact by a motor vehicle, which area will be dictated considerations known to those skilled in the art, including motor vehicle bumper height. According to the illustrated embodiment, each reinforcing member 50 is positioned proximate the bottom of the associated mast portion 35 and, as specifically shown, is positioned so that an end thereof is approximately coterminous with the bottom end of the associated mast portion 35. Each reinforcing member 50 is fixedly disposed in place relative to its associated mast portion 35, for instance by spot welding.

Further according to the illustrated embodiment, the reinforcing member 50 disposed within each of the mast portions 35 comprises steel tubing commercially available under the denomination "Schedule 40," and having a 1 inch inside diameter. In the invention as shown, according to which the mast portions 35 are each characterized by longitudinal dimensions of approximately 96 inches, the reinforcing members 50 are characterized by longitudinal dimensions of approximately 48 inches.

Of course, the foregoing construction of reinforcing members 50 is exemplary only, and materials of at least comparable strength may be substituted therefor with the expectation of similar performance. Likewise, it will be appreciated that the dimensions of reinforcing members 50 may be varied according to the dimensions of the associated mast portion 35, subject only to the requirement of compliance by the traffic control sign incorporating the same with governing crashworthiness standards, such as NCHRP Report 350 Test Designation 3-71.

Figures 3A, 3B:
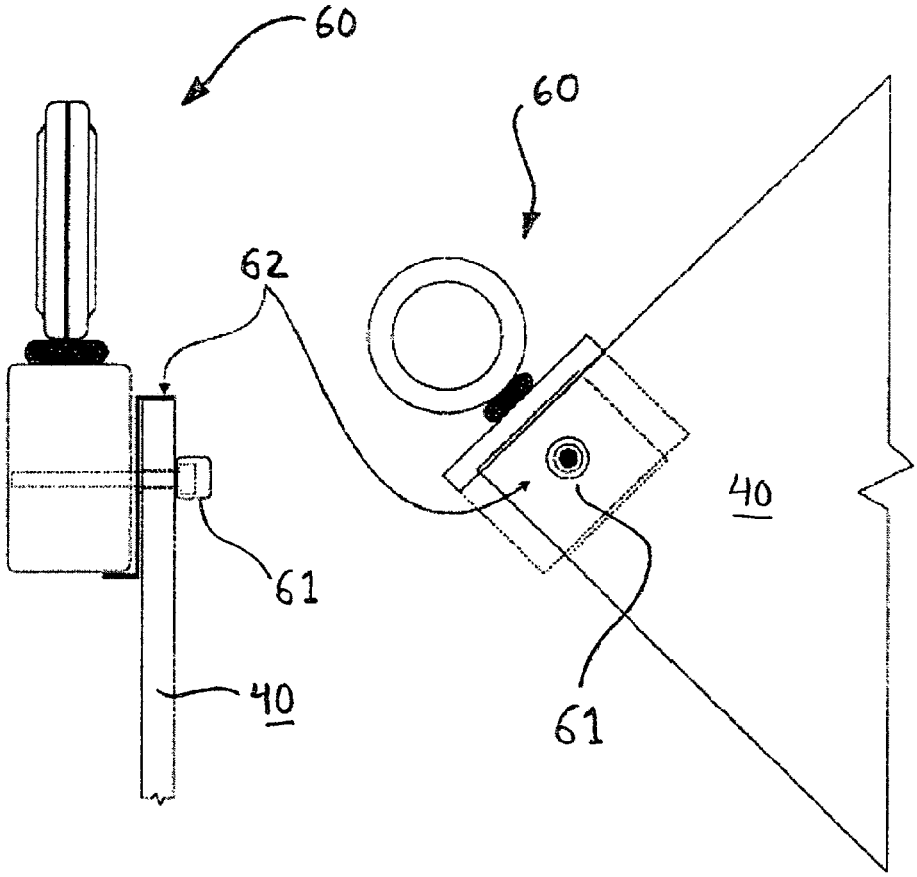
FIGS. 3*a* and 3*b* are detailed views showing one possible mounting arrangement for disposing a light unit on a traffic control sign according to the present invention.

Referring now to FIGS. 2, 3*a* and 3*b*, the traffic control sign of the instant invention may, as desired, be further provided with a light unit 60, such as the illustrated battery-operated flashing light unit of conventional manufacture. To the extent employed, it is desirable that any such light unit 60 be positioned on the sign panel 40 proximate the likely impact point of the sign panel with the body of a motor vehicle. In the case of the illustrated diamond-type sip panel 40, such impact point comprises the apex defined between two sides of the sign which will be positioned proximate the roadway.

Mounting of the light unit 60 according to the illustrated embodiment is accomplished via at least one mounting bolt 61 received through the sign panel 40 and threadingly connected to the light unit 60. A "Z"-shaped bracket 61 having oppositely extending lateral walls is captured between the light unit 60 and sign panel 40, as shown, and serves to prevent undesired rotational movement of the light unit.

Figure 4A:
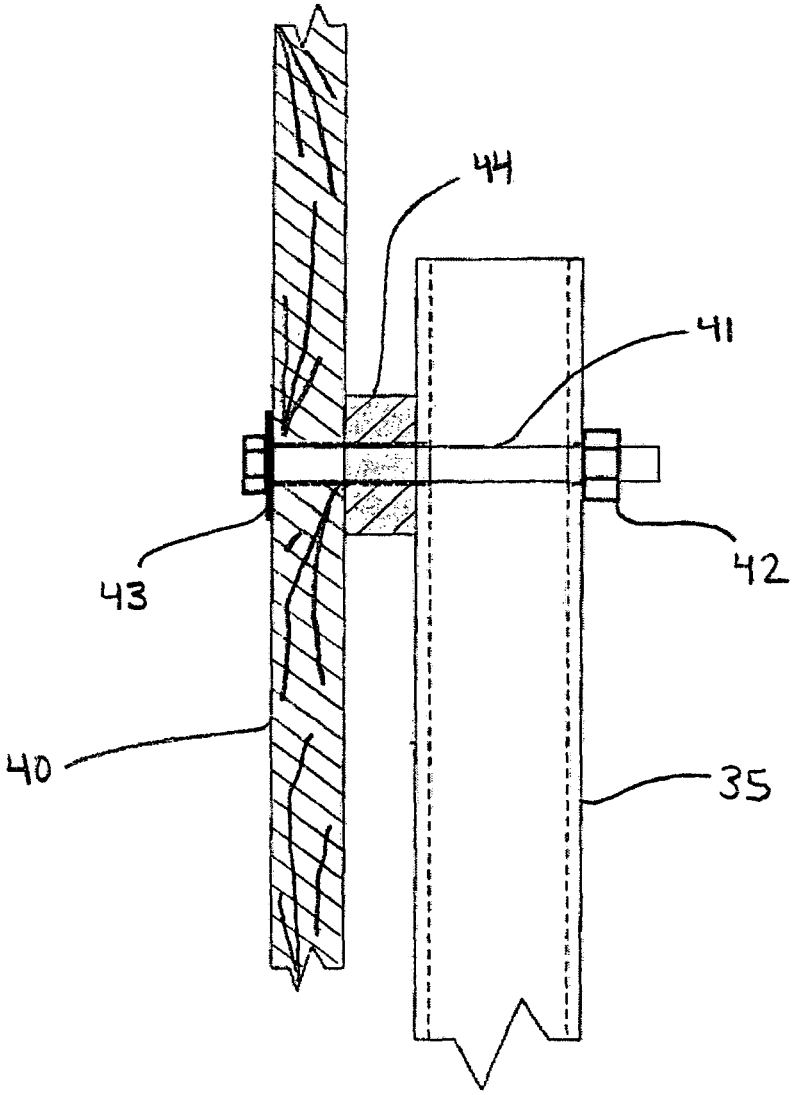
FIGS. 4*a* and 4*b* comprise detailed views of two alternate embodiments for securing a sign panel to a mast in the traffic control sign of the present invention.
Figure 4B:
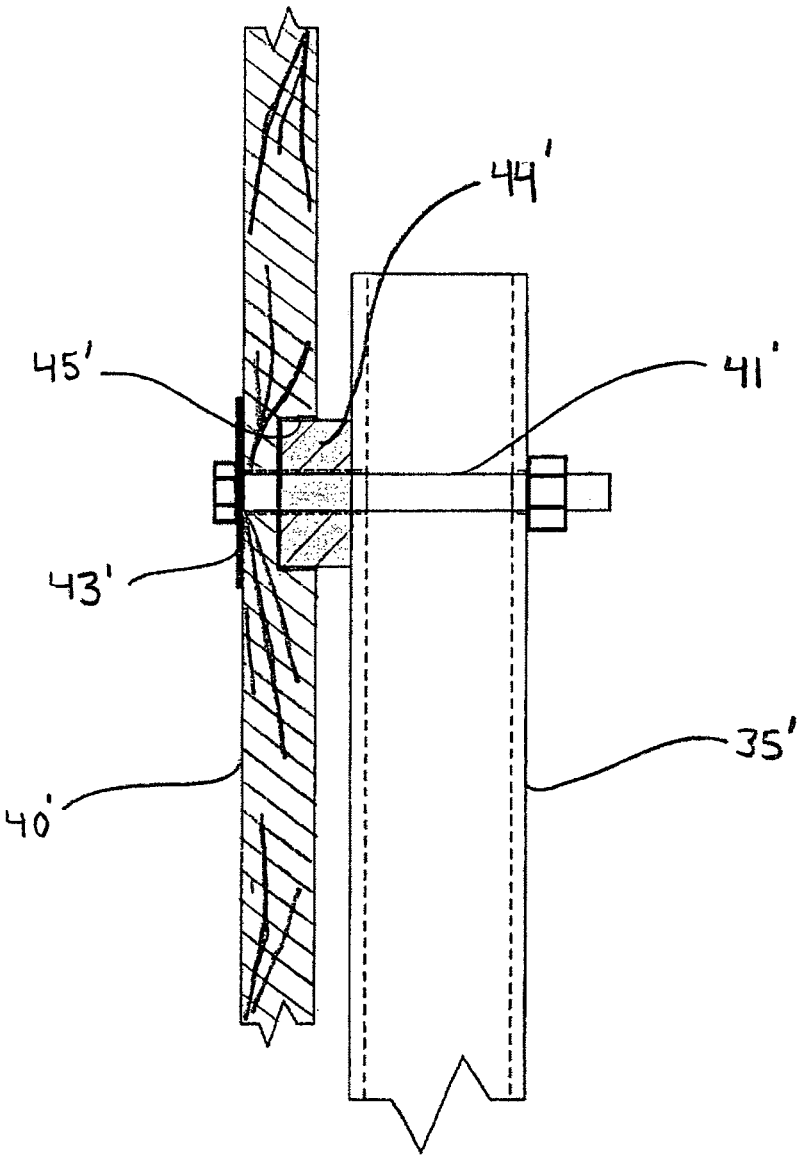

With reference now being had to FIGS. 4*a* and 4*b*, there are depicted two alternate means by which a sign panel 40 may be secured to the at least one mast 35 in the traffic control sign of this invention. According to the first such embodiment, shown in FIG. 4*a*, the sign panel 40 is secured to each mast portion 35 by fastening means such as the illustrated bolt 41, nut 42, and washer 43 assembly, the bolt 41 passing through a bore in the sign panel 40, as well as through holes provided in the mast portion 35. As shown, the stem of bolt 41 further passes through a spacer 44 interposed between the rear surface of the sign panel 40 and the opposing surface of mast portion 35. Without wishing to be bound by any particular theory of operation, it is believed that the spacer 44 beneficially serves to position the sign panel 40 a distance from the mast portion 35 which is sufficient to permit greater flexing movement of the sign panel 40 relative to the mast portion 35 under the force of impact by a motor vehicle, thereby increasing the likelihood that the sign panel 40 will separate from the mast 35 and so strike the impacting motor vehicle, if at all, with lesser force. In the illustrated embodiment, the spacer 44 shown is characterized by a thickness of approximately 0.625 inches and a diameter of 1.25 inches. However, these dimensions may be varied consistent with achieving the stated objectives of positioning the at least one sign panel 40 from the at least one mast portion 35.

According to an alternate embodiment, illustrated in FIG. 4*b*, sign panel 40' includes a blind bore 45' in the rear surface thereof, the bore being dimensioned to partially receive the spacer 44' therein. Per this embodiment, the sign panel 40' is positioned closer to, but not in contact with, the mast portions 35', which arrangement, in combination with the decreased thickness in the sign panel 40 in the area behind the bore 45', facilitates the likely separation between the sign panel 40 and mast portions 35 under the force of impact by a motor vehicle. As shown, a washer 43' of greater surface area than that illustrated in the embodiment of FIG. 4*a* is preferred for the embodiment of FIG. 4*b*, in order to decrease the likelihood of unwanted separation of the sign panel 40 from the mast portions 35 during routine handling and movement of the traffic control sign.

Experimental Test Results

A pair of traffic control signs according to the instant invention were subject to evaluation under the standards of NHCRP Report 350 Test Designation 3-71, which protocol is designed to evaluate the risk of impact to occupants of a motor vehicle. For this evaluation, the traffic control signs tested incorporated the elements as described in respect of FIGS. 2-4*a*, above, and were characterized by the dimensions as set forth herein for that illustrated embodiment of this invention.

According to Test Designation 3-71, a recommended 1808 lb. test vehicle (see Table I) is impacted with the test device at a nominal speed of 66.2 mph with a critical impact angle of between 0 degrees and 20 degrees of the normal traffic direction.

TABLE I

Recommended Properties of Test Vehicle

| Property | 820C (Small Car) |
|---|---|
| MASS (kg) | |
| Test Inertial | 820 ± 25 |
| Dummy | 75 |
| Maximum Ballast | 80 |
| Gross Static | 895 ± 25 |
| DIMENSIONS (cm) | |
| Wheelbase | 230 ± 10 |
| Front Overhang | 75 ± 10 |
| Overall Length | 370 ± 20 |
| Track Width (average) | 135 ± 10 |
| CENTER OF MASS LOCATION (cm) | |
| Aft of Front Axle | 80 ± 15 |
| Above Ground | 55 ± 5 |
| LOCATION OF ENGINE | Front |
| LOCATION OF DRIVE AXLE | Front |
| TRANSMISSION TYPE | Manual or Automatic |

In the full-scale crash test of this experiment, the traffic control signs were particularly subjected to sequential impact by a 1924 lbs. (gross static weight) 1998 model Chevrolet Metro at a speed of approximately 61.01 mph. The approximate height of the center of the test vehicle's front bumper was 16 inches.

Pursuant to the requirements of NHCRP Report 350 Test Designation 3-71, the test signs were positioned in the path of travel of the test motor vehicle approximately 236 inches apart, with the first test sign being oriented parallel to the path of travel of the test motor vehicle and the second test sign being oriented perpendicular to the path of travel of the test motor vehicle.

Further to the foregoing, the test signs of the present invention satisfied all relevant evaluation criteria, including structural adequacy (the inventive signs permitted the test motor vehicle to break through the traffic control sign upon impact), occupant risk (the test signs did not intrude into the motor vehicle's occupant compartment, did not cause significant deformation of the motor vehicle body into the occupant compartment, and did not cause damage or yield debris which would block the vision of the driver of the test motor vehicle), and vehicle trajectory (the test motor vehicle continued past the test signs). These criteria are more fully identified in Table II.

TABLE II

Safety Evaluation Guidelines

| Evaluation Factors | Evaluation Criteria |
|---|---|
| Occupant Risk | Detached elements, fragments or other debris from the test article should not penetrate or show potential for penetrating the occupant compartment, or present an undue hazard to other traffic, pedestrians, or personnel in a work zone. Deformations of, or intrusions into, the occupant compartment that could cause serious injuries should not be permitted. |
| Occupant Risk | Detached elements, fragments or other debris from the test article, or vehicular damage should not block the driver's vision of otherwise cause the driver to lose control of the vehicle. |
| Occupant Risk | The vehicle should remain upright during and after collision although moderate roll, pitching and yawing are acceptable. |
| Occupant Risk | Occupant longitudinal impact velocity limits (in m/s) should satisfy the following: Preferred: 3 m/s Maximum: 5 m/s |
| Occupant Risk | Occupant longitudinal and lateral ridedown accelerations (in G's) should satisfy the following: Preferred: 15 G's Maximum: 20 G's |
| Vehicle Trajectory | After collision it is preferable that the vehicle's trajectory not intrude into adjacent traffic lanes. |
| Vehicle Trajectory | Vehicle trajectory behind the test article is acceptable. |
| Structural Adequacy | The test article should readily activate in a predictable manner by breaking away, fracturing or yielding. |

It will be appreciated from the above disclosure that the present invention provides a means for the facile and economical modification of existing inventories of traffic control signs to bring the same into conformance with new safety standards for such traffic control devices, while maintaining the man-portable nature of such devices.

Of course, the foregoing embodiments are merely illustrative of the present invention, and those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A portable traffic control sign, comprising:

a stand capable of resting on a support surface;

at least one mast portion extending upwardly from the stand, the at least one mast portion having a bottom and a top, a substantially hollow interior and an outside diameter of less than approximately 1.75 inches, the bottom of the at least one mast portion being slidingly associated with the stand with no mechanical connection so that the at least one mast portion is freely separable from the stand;

at least one sign panel having front and rear surfaces, the at least one sign panel connected to the at least one mast portion so that the front surface of the at least one sign panel faces away from the at least one mast portion and the rear surface of the at least one sign panel faces towards the at least one mast portion;

a separate reinforcing member fixedly disposed in the hollow interior of each at least one mast portion such that the reinforcing member remains with the mast portion when the same is removed from the stand, the reinforcing member positioned so as to reinforce the at least one mast portion against a motor vehicle impact in the area of the at least one mast portion reinforced by the reinforcing member; and wherein the at least one sign panel is connected to the at least one mast portion at a single location only, and is positioned at a distance from the at least one mast portion, and wherein further a spacer is positioned between the at least one sign panel and the at least one mast portion at the single location where they are connected, the dimensions of the spacer being such that, along the upwardly extending length of the at least one mast portion, the majority of the rear surface of the at least one sign panel is not in contact with either the spacer or the at least one mast portion.

2. The traffic control sign of claim 1, further characterized in that, in an impact at an angle of from 0 to 20 degrees relative to an imaginary line running perpendicular to the plane of either of the front or rear surfaces of the at least one sign panel, the impact occurring between the traffic control sign and a motor vehicle of approximately 1800 lbs traveling at approximately 66 mph, the traffic control sign does not penetrate into the occupant compartment of the motor vehicle.

3. The traffic control sign of claim 1, wherein the reinforcing member comprises steel.

4. The traffic control sign of claim 1, wherein the at least one mast portion has an outside diameter of no larger than approximately 1.50 inches.

5. The traffic control sign of claim 4, wherein the reinforcing member comprises steel.

6. The traffic control of claim 5, wherein the reinforcing member comprises steel tubing having an internal diameter of approximately 1 inch.

7. The traffic control sign of claim 6, wherein the reinforcing member is fixedly disposed proximate the bottom of the at least one mast portion, and wherein further the reinforcing member has a length of approximately 48 inches.

8. The traffic control sign of claim 1, wherein the spacer has a thickness of approximately 0.625 inches.

9. The traffic control sign of claim 1, wherein the spacer is at least partially disposed in a bore provided in the sign panel.

10. The traffic control sign of claim 9, wherein the spacer has a thickness of approximately 0.625 inches.

11. A portable traffic control sign, comprising:

at least a pair of stands capable of resting on a support surface;

at least two mast portions extending upwardly from the at least pair of stands, each mast portion slidingly associated with one of the at least pair of stands with no mechanical connection so that each mast portion is freely separable from its associated stand, and each such mast portion comprising a length of metal tubing having a bottom and a top, a substantially hollow interior, and an outside diameter of approximately 1.5 inches;

at least one sign panel connected to the mast portions, the at least one sign panel having front and rear surfaces, the at least one sign panel connected to the mast portions so that the front surface of the at least one sign panel faces away from the mast portions and the rear surface of the at least one sign panel faces towards the mast portions;

a separate reinforcing member fixedly disposed in the hollow interior of each of the mast portions such that the reinforcing member remains with its associated mast portion when the mast portion is removed from the stand, the reinforcing member positioned so as to reinforce its associated mast portion against a motor vehicle impact in the area of the mast portion reinforced by the reinforcing member; and wherein the at least one sign panel is connected to each mast portion at a single location only, and is positioned at a distance from the mast portions, and wherein further a spacer is positioned between the at least one sign panel and each of the mast portions at the locations where they are connected, the dimensions of the spacers being such that, along the upwardly extending length of each mast portion, the majority of the rear surface of the at least one sign panel is not in contact with either the spacer or the mast portion.

12. The traffic control sign of claim 11, further characterized in that, in an impact at an angle of from 0 to 20 degrees relative to an imaginary line running perpendicular to the plane of either of the front or rear surfaces of the at least one sign panel, the impact occurring between the traffic control sign and a motor vehicle of approximately 1800 lbs traveling at approximately 66 mph, the traffic control sign does not penetrate into the occupant compartment of the motor vehicle.

13. The traffic control sign of claim 11, wherein each reinforcing member comprises steel.

14. The traffic control sign of claim 13, wherein each reinforcing member comprises steel tubing having an internal diameter of approximately 1 inch.

15. The traffic control sign of claim 14, wherein each reinforcing member is fixedly disposed proximate the bottom of each mast portion, and wherein further each reinforcing member has a length of approximately 48 inches.

16. The traffic control sign of claim 11, wherein the spacer has a thickness of approximately 0.625 inches.

17. The traffic control sign of claim 11, wherein the spacer is at least partially disposed in a bore provided in the sign panel.

18. The traffic control sign of claim 17, wherein each spacer has a thickness of approximately 0.625 inches.

19. A portable traffic control sign, comprising:

a stand adapted to rest on a support surface;

at least one mast portion extending upwardly from the stand, the at least one mast portion having a bottom, a top, and a substantially hollow interior, the bottom of the at least one mast portion slidingly associated with the stand with no mechanical connection so that the at least one mast portion is freely separable from the stand;

at least one sign panel having front and rear surfaces, the at least one sign panel connected to the at least one mast portion so that the front surface of the at least one sign panel faces away from the at least one mast portion and the rear surface of the at least one sign panel faces towards the at least one mast portion;

a separate reinforcing member fixedly disposed in the hollow interior of each at least one mast portion such that the reinforcing member remains with the mast portion when the mast portion is removed from the stand, the reinforcing member positioned so as to reinforce the at least one mast portion against a motor vehicle impact in the area of the at least one mast portion reinforced by the reinforcing member; and wherein the at least one sign panel is connected to the at least one mast portion at a single location only, and is positioned at a distance from the at least one mast portion, and wherein further a spacer is positioned between the at least one sign panel and the at least one mast portion at the single location where they are connected, such that, along the upwardly extending length of the at least one mast portion, the majority of the rear surface of the at least one sign panel is not in contact with either the spacer or the at least one mast portion.

20. A portable traffic control sign, comprising:

a stand capable of resting on a support surface;

at least one mast portion extending upwardly from the stand, the at least one mast portion having a bottom and a top, a substantially hollow interior and an outside diameter of less than approximately 1.75 inches, the bottom of the at least one mast portion being slidingly associated with the stand with no mechanical connection so that the at least one mast portion is freely separable from the stand;

at least one sign panel connected to the at least one mast portion, the at least one sign panel having front and rear surfaces;

a separate reinforcing member fixedly disposed in the hollow interior of each at least one mast portion such that the reinforcing member remains with the mast portion when the same is removed from the stand, the reinforcing member positioned so as to reinforce the at least one mast portion against a motor vehicle impact in the area of the at least one mast portion reinforced by the reinforcing member; and wherein the at least one sign panel is connected to the at least one mast portion at a single location only, and is positioned at a distance from the at least one mast portion, and wherein further a spacer is positioned between the at least one sign panel and the at least one mast portion at the single location where they are connected, the spacer being at least partially disposed in a bore provided in the sign panel.

21. The traffic control sign of claim 20, wherein the spacer has a thickness of approximately 0.625 inches.

22. A portable traffic control sign, comprising:

at least a pair of stands capable of resting on a support surface;

at least two mast portions extending upwardly from the at least pair of stands, each mast portion slidingly associated with one of the at least pair of stands with no mechanical connection so that each mast portion is freely separable from its associated stand, and each such mast portion comprising a length of metal tubing having a bottom and a top, a substantially hollow interior, and an outside diameter of approximately 1.5 inches;

at least one sign panel connected to the mast portions, the at least one sign panel having front and rear surfaces;

a separate reinforcing member fixedly disposed in the hollow interior of each of the mast portions such that the reinforcing member remains with its associated mast portion when the mast portion is removed from the stand, the reinforcing member positioned so as to reinforce the at least one mast portion against a motor vehicle impact in the area of the at least one mast portion reinforced by the reinforcing member; and wherein the at least one sign panel is connected to each mast portion at a single location only, and is positioned at a distance from the mast portions, and wherein further a spacer is positioned between the at least one sign panel and each of the mast portions at the locations where they are connected, the spacer being at least partially disposed in a bore provided in the sign panel.

23. The traffic control sign of claim 22, wherein each spacer has a thickness of approximately 0.625 inches.

* * * * *